United States Patent [19]

Brunner et al.

[11] 4,297,707

[45] Oct. 27, 1981

[54] MULTIPLE OMNIDIRECTIONAL ANTENNA

[75] Inventors: Anton Brunner, Wangen; Nikolaus Willburger, Olching, both of Fed. Rep. of Germany

[73] Assignee: Siemens Aktiengesellschaft, Berlin & Munich, Fed. Rep. of Germany

[21] Appl. No.: 45,228

[22] Filed: Jun. 4, 1979

Related U.S. Application Data

[63] Continuation of Ser. No. 810,592, Jun. 27, 1977, abandoned.

[30] Foreign Application Priority Data

Jun. 30, 1976 [DE] Fed. Rep. of Germany ..... 2629502

[51] Int. Cl.[3] ..... H01Q 13/12

[52] U.S. Cl. ..... 343/725; 343/769; 343/770

[58] Field of Search ..... 343/726–729, 343/769, 770, 771, 846

[56] References Cited

U.S. PATENT DOCUMENTS

| | | | |
|---|---|---|---|
| 2,471,021 | 5/1949 | Bradley | 343/769 |
| 3,945,013 | 3/1976 | Brunner et al. | 343/729 |
| 4,037,540 | 7/1977 | Keydel | 343/769 |

*Primary Examiner*—Eli Lieberman

*Attorney, Agent, or Firm*—Hill, Van Santen, Steadman, Chiara & Simpson

[57] ABSTRACT

A multiple omnidirectional antenna, utilizing individual antennae for different frequencies, and/or different polarizations, disposed along a common axis, and employing a multiple coaxial feed from one side only, in which the omnidirectional antenna which is remote from the feed side, is in the form of an axial wave-guide section, with the portion defining the walls thereof being connected to the outer conductor of the innermost coaxial feed line, and at least, in effect, defining at least one slot therein which runs transversely to the desired polarization direction of such antenna, with the inner conductor of the innermost coaxial feed line forming the exciting element therefor and projecting into the interior of said wave-guide, and/or at least one other omnidirectional antenna in the form of a coaxial line section, the walls of which are connected to the outer conductor of another coaxial feed line, and are provided with at least one slot therein which runs transversely to the desired polarization direction of said antenna, with the inner conductor of such other coaxial line passing through the interior of said coaxial line section. Combinations of horizontal, vertical and circular polarizations may be employed.

5 Claims, 5 Drawing Figures

MULTIPLE OMNIDIRECTIONAL ANTENNA

This is a continuation, of application Ser. No. 810,592, filed June 27, 1977, now abandoned.

BACKGROUND OF THE INVENTION

The invention relates to a multiple omnidirectional antenna employing a plurality of antenna sections designed for different operational frequencies and disposed along a common axis and utilizing multiple coaxial feed from one side only.

It is known, for the simultaneous reception and simultaneous emission of electromagnetic waves of different frequencies in the microwave range with specific polarizations, in which an omnidirectional diagram is formed in the horizontal plane, and a wide radiation diagram is formed in the vertical plane, to employ omnidirectional antennae which are disposed adjacent to one another and are selected for the particular polarization desired. However, with such an arrangement a mutual influence or reaction occurs between the individual antennae, thus producing interference which is unacceptable in most applications, and in particular in connection with secondary radar transponder devices which are intended to simultaneously effect a coding operation at a plurality of frequencies.

German OS No. 23 54 550 discloses an integrated double omnidirectional antenna with a double coaxial feed. The two antennae which operate at different frequencies are constructed along a double coaxial line structure in two sections, one disposed above the other, on a single axis, in which the lower and upper section can be selectively designed either as a unipole for vertical polarization or as coaxial line radiator, provided with a slot and a short-circuiting pin for horizontal polarization. This known integration is, in itself, sufficient to combine two omnidirectional antennae for more or less different frequencies, in such a way that their omnidirectional characteristics are not disturbed as a result of their disposition on a common axis.

BRIEF SUMMARY OF THE INVENTION

The invention has among its objects the production of a multiple omnidirectional antenna for electromagnetic waves of different frequencies, which in comparison to the known double omnidirectional antenna which has at least one slotted coaxial line radiator, exhibits a greater frequency band width and can also be designed for radiation with arbitrary linear polarization.

In accordance with the invention, this objective, with respect to a multiple omnidirectional antenna of the type referred to, is realized by an arrangement in which the omnidirectional antenna, which faces away from or is remote from the feed side of the structure, comprises an axial wave guide section or tube, the walls of which are connected to the outer conductor of the innermost coaxial feed line section, such walls are provided with one or more slots which run transversely to the desired polarization direction of such an antenna, and into the interior of which the inner conductor of the innermost coaxial feed line section extends to form the exciting component, and/or that at least one of the other omnidirectional antennae comprises a coaxial conductor section or tube, the walls of which are connected to the outer conductor of another coaxial feed line and provided with one or more slots running transversely to the desired polarization direction of such an antenna with the inner conductor of such coaxial line extending through the interior of such section.

If one of the antennae is designed for the emission of electromagnetic waves in horizontal polarization direction, it is expedient to provide a pin adjacent each respective slot involved, which pin projects radially into the interior of the section with the slots in this case running parallel to the axial direction.

BRIEF DESCRIPTION OF THE DRAWINGS

In the drawings wherein like reference characters indicate like or corresponding parts.

DETAILED DESCRIPTION OF THE INVENTION

Figures 1, 2, 3, 3A:
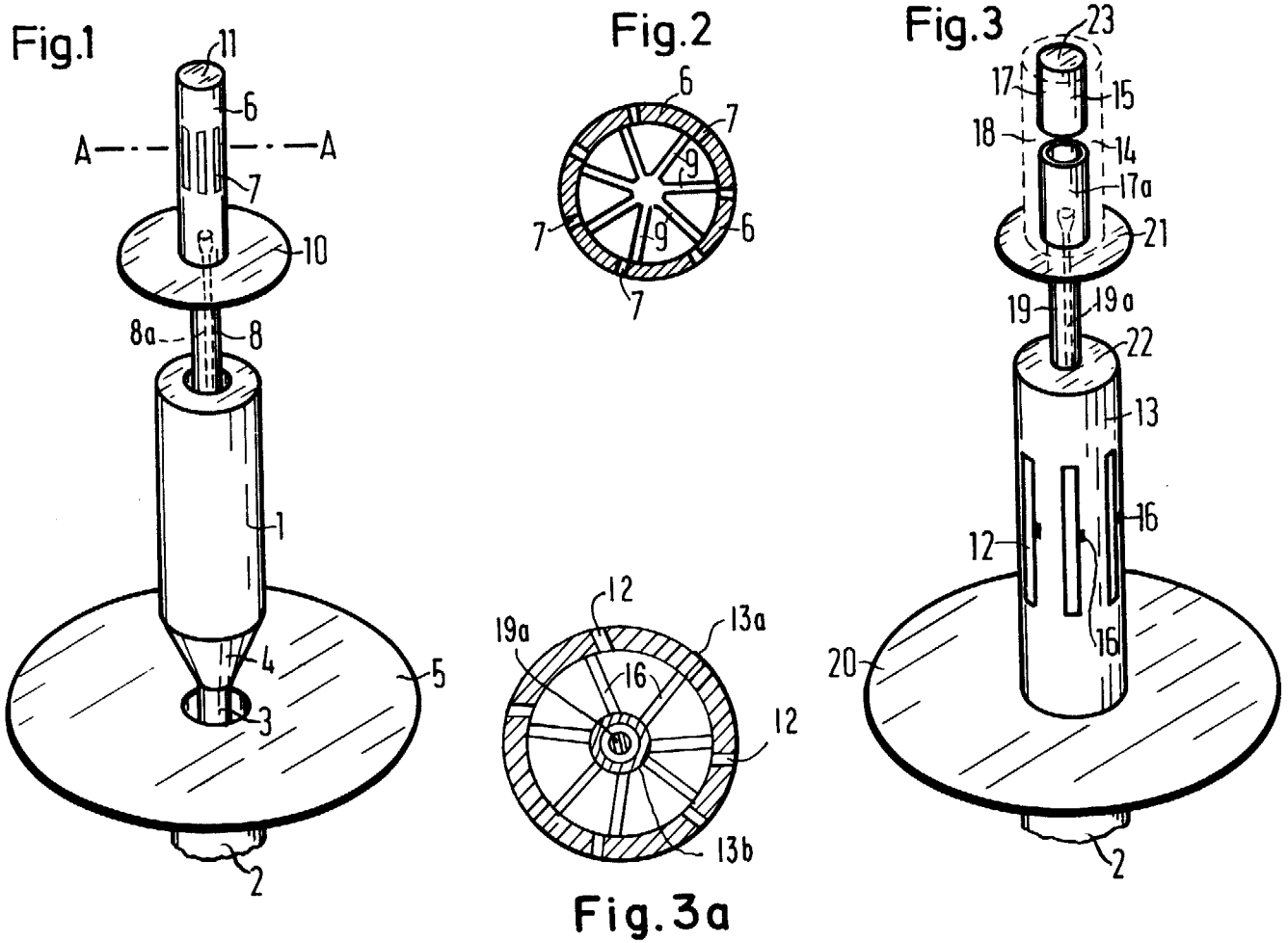
FIG. 1 is an oblique view of a transponder double omnidirectional antenna for the radiation of electromagnetic waves of a lower frequency band in vertical polarization direction, and of a higher frequency band in horizontal polarization direction.
FIG. 2 is an enlarged sectional view taken approximately on the line A—A of FIG. 1.
FIG. 3 is an oblique view of a transponder double omnidirectional antenna for the radiation of an electromagnetic waves of a lower frequency band in horizontal polarization direction, and of a higher frequency band in vertical polarization direction.
FIG. 3*a* is a sectional view taken through the slots 12 of the member 13 in FIG. 3.

Referring to FIG. 1, the double antenna therein illustrated comprises two omnidirectional antennae sequentially arranged, one above the other along a double coaxial line forming the feed therefor, adapted for use in a transponder involving a coding operation which is to be carried out at two frequencies. The omnidirectional antenna for the lower frequency band, for example the L-band, is in this case formed by a unipole 1 which constitutes the lower antenna. Such unipole is fed by an outer supply coaxial line which comprises an outer conductor 2 and an inner conductor 3, with the latter merging into the unipole 1 over a conical shaped surface 4, while the outer conductor 2 is extended radially outward to form a generally circular base plate 5. The portion of the unipole 1 which extends from the base plate 5 amounts to approximately one quarter of the wave length of the electromagnetic waves of the lower frequency band. The unipole illustrated is designed to radiate in vertical polarization direction.

The electromagnetic waves exhibiting horizontal polarization with a higher frequency are formed by a wave-guide section 6 of circular cross section, in $TM_{01}$-excitation. The walls of the wave-guide section 6 are provided with a plurality of longitudinally extending slots 7 with the wave-guide section 6 being supplied by a small diameter coaxial line 8, the inner conductor of which extends into the section 6. Such coaxial line 8 extends through the inner conductor 3 of the large diameter coaxial line 2, i.e. the feed line of the unipole 1, and advantageously may be constructed as a "semi-rigid coaxial cable".

The axially extending slots 7 in the wave-guide section 6 are excited by so disturbing the axial wall currents that they form tangential components which pass through the axial slots 7 as displacement currents, and thus produce a horizontally polarized radiation. Such excitation is produced by radially extending pins 9, each of which are disposed closely adjacent to the associated slots 7, and expediently are arranged in a star-shaped configuration. The number of slots 7 is dependent upon the permissible ripple in the horizontal diagram. For example, seven slots will be adequate for many omnidirectional antenna applications. The inner conductor 8*a* extends up through the coaxial line 8 and extends through an opening formed in the base plate 10 and terminates within the confines of the cylindrical waveguide section 6 as shown in FIG. 1.

The vertical diagram of the two omnidirectional antennae is dependent upon the height and the diameter of the base plates 5 and 10. The omnidirectional waveguide section 6 is terminated at its upper end by a short circuiting plate. It will be appreciated that the pins 9 are illustrated merely in FIG. 2, from which it will be apparent that the pins 9 are disposed in a star-shaped configuration and each disposed closely adjacent to the associated axial slot 7 on the section 6 which obviously has a circular cross-section.

FIG. 3 illustrates a double omnidirectional antenna in which electromagnetic waves at the lower frequency are horizontally polarized and are emitted by a coaxial line section 13 provided with longitudinal slots 12, and at the higher frequency vertically polarized waves are emitted by a wave-guide section 15 of circular cross-section which is provided with a transversely extending annular slot 14, and likewise, involves $TM_{01}$-excitation. The slots 12 of the coaxial line section 13, which possess the same wall currents as the omnidirectional waveguide section 6, exhibiting $TM_{01}$-excitation, corresponds to the antenna arrangement illustrated in FIGS. 1 and 2 and can be excited in like manner. The exciting pins 16 each form a radial connection between the outer conductor and the inner conductor of the coaxial line 13.

The upper section 17, disposed above the slot 14, of the wave guide 15 is retained in position by a suitable synthetic sleeve 18 which also is operative to provide an effective seal between the two sections of the wave guide. The antenna structure of FIG. 3 is fed by means of a double coaxial line, the outermost conductor 2 of which is connected to the outer conductor of the coaxial antenna 13 while the inner conductor of such outer coaxial line passes through the coaxial antenna and is connected, to the wave-guide antenna 15, forming the outer conductor 19 of the inner coaxial line supplying the wave-guide antenna 15. The inner conductor of the inner coaxial line is operative to excite the slotted waveguide antenna disposed thereabove. The coaxial line antenna and the wave-guide antenna are terminated at their top portions by respective short-circuiting plates 22 and 23. The vertical diagrams of the two omnidirectional antennae are also dependent upon the height and diameter of the two base plates 20 and 21. As shown in FIG. 3, the inner conductor 19*a* of the outer conductor 19 extends through an opening formed in the base plate 21 and terminates within the confines of the antenna 15. The upper cylindrical portion 17 and the lower cylindrical portions 17*a* are separated by a slot 14 as illustrated in FIG. 3. FIG. 3*a* is a sectional view taken through the slots 12 of the cylindrical member 13 and illustrates the inner cylindrical member 13*b* to which are attached a plurality of radially extending pins 16 which are attached to the wall of the cylindrical portion 13 adjacent the side of the slots 12 as illustrated in FIG. 3*a* and FIG. 3.

Figure 4:
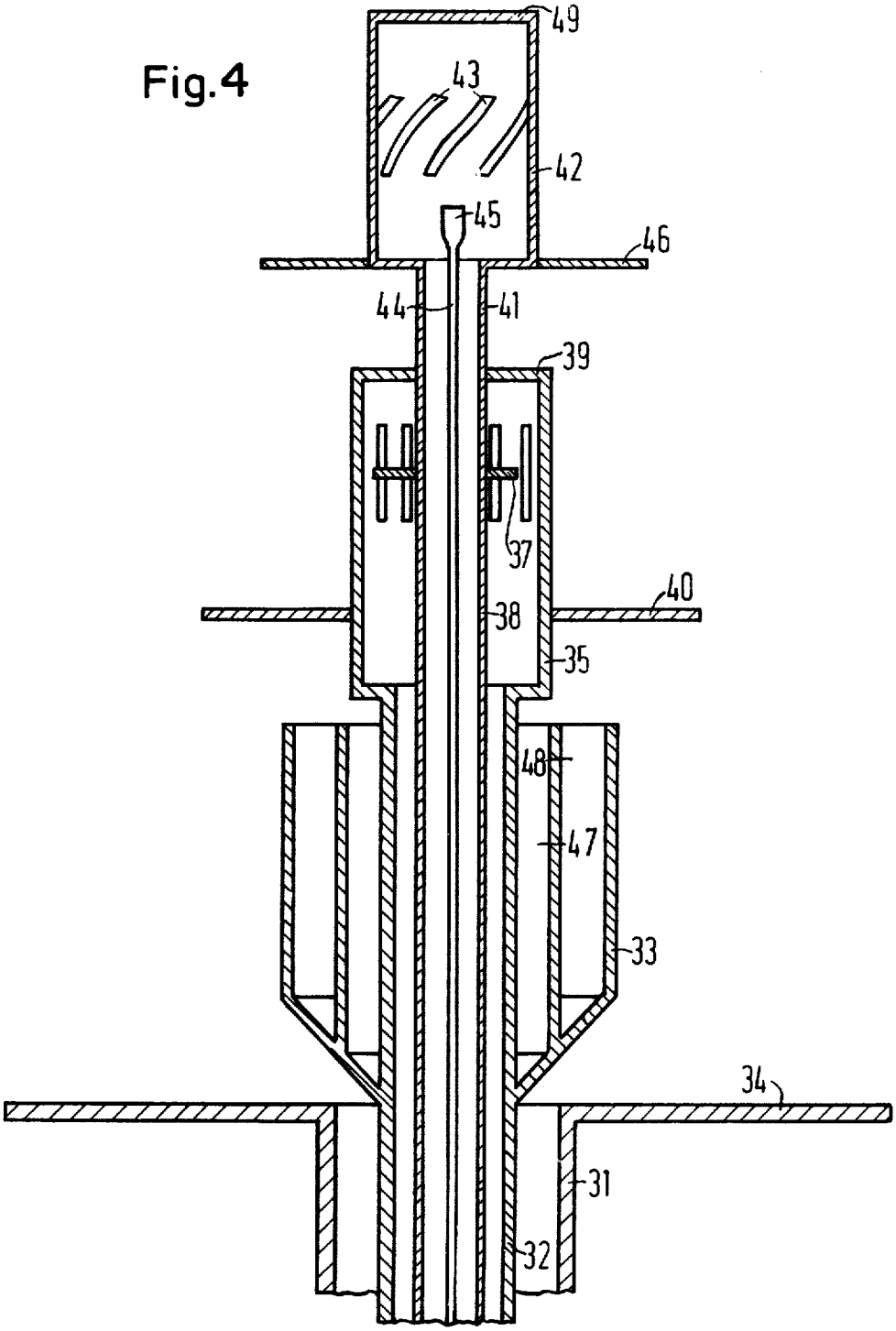
FIG. 4 is a sectional view of a triple omnidirectional antenna for radiation of electromagnetic waves of a lower frequency band in vertical polarization direction, radiation of a middle frequency band in horizontal polarization direction, and of a higher frequency band with 45° linear polarization.

FIG. 4 illustrates an embodiment of the invention in the form of a triple omnidirectional antenna providing various polarizations. In this construction, the antenna for the lower frequency band is formed by a unipole which emits vertically polarized electromagnetic waves and which, in the construction illustrated, forms the lower antenna. Such unipole is fed by the outer coaxial supply line, with the latter comprising an inner conductor 32 which merges into a rod or cylindrical antenna 33, while the outer conductor 31 terminates in an outwardly extending circular base plate 34. The portion of the rod antenna 33 projecting above the base plate 34, forming the unipole, amounts to approximately one-quarter wave length of the electromagnetic waves of the lower frequency band.

The inner conductor 32 of the outer coaxial line simultaneously forms the outer conductor 35, of a central or middle coaxial line section, which is operable for the feed of the middle antenna in the middle frequency range. The outer conductor 35 of such middle antenna is provided with axial slots 36, which, as illustrated, are excited by means of pins 37 extending radially inward to produce a horizontally polarized radiation. The exciting pins 37, each of which is disposed closely adjacent the associated or cooperable slot 36, extend inwardly in a star-shaped configuration with their inner ends being connected to the inner conductor 38 of the middle coaxial line. Such coaxial line antenna is terminated at the top thereof by a short-circuiting plate 39 and is also provided with a circular base plate 40, the position and design of which can be such that a desired influence of the vertical diagram of the central antenna may be achieved.

The inner conductor 38 of the middle coaxial line simultaneously forms the outer conductor 41 of the innermost coaxial line. The conductor 41 terminates at its upper end in an enlarged portion which forms a wave-guide section 42, illustrated as being provided with slots 43 disposed at 45°. Such upper wave-guide antenna, which is terminated at its upper end by a flat short-circuiting plate 49, is excited over the inner conductor 44 of the inner coaxial line, which conductor, as illustrated, terminates at its upper end in an enlarged portion 45 and acts as an $TM_{01}$ exciter.

The wave-guide antenna, which is responsible for the highest of the three frequency ranges of the entire antenna structure, produces electromagnetic waves exhibiting a 45° linear polarization, and in addition exhibits omnidirectional characteristics in its horizontal diagram. The vertical diagram of the upper antenna may be influenced by the position and design of the circular base plate 46.

In order to prevent the two upper antennas from being excited by electromagnetic waves of the lower frequency band, the rod antenna 33 is provided with pot-like spaces 47 and 48, which have a depth of approximately a quarter wave length of the electromagnetic waves of the lower frequency band, and function as a current trap.

It will be appreciated that the combination of polarizations is not restricted to the arrangement illustrated in FIG. 4 as the triple omnidirectional antenna can be constructed with any of the other combinations of three polarizations, which can, for example, be effected by the configuration of the slots employed.

It will be appreciated from the above that the described examplary embodiments of both wave-guide antennas and coaxial line antennas are, strictly speaking, slot antennae, with the other designations being utilized merely for the purposes of achieving a clear description of the specific arrangements. Likewise, for the purposes of the disclosure and claims, the circular polarization of the upper omnidirectional antenna may, in effect, be considered a slotted axial wave-guide structure or section of exaggerated proportions.

Having thus described our invention it will be obvious that although various minor modifications might be suggested by those versed in the art, it should be understood that we wish to embody within the scope of the patent granted hereon all such modifications as reasonably, and properly come within the scope of our contribution to the art.

We claim as our invention:

1. An omnidirectional end antenna which forms an assembly with one or more other antennas mounted on a common axis comprising a wave shaping base plate member (10, 21, 46), a coaxial feed line having an outer conductor (8, 19, 41) attached to said base plate member (10, 21, 46) on one side thereof and extending through said one or more other antennas, an opening formed in said base plate member, an inner conductor (8*a*, 19*a*, 44) of said feed line extending for a finite length through said opening formed in said base plate member (10, 21,46), a cylindrical shaped radiating member (6, 17, 42) into which the end of feed line extends attached to the second side of said base plate member (10, 21, 46) and formed with a short circuit cover member (11, 23, 49) over its remote end, and at least one radiating slot (7, 14, 43) formed in the side walls for radiating radiant energy.

2. An omnidirectional antenna according to claim 1, wherein a plurality of slots are formed in the hollow cylindrical shaped radiating member which extend in the axial direction and a plurality of pins 9 and each pin projects radially into the interior of the section and is disposed closely adjacent one of said slots.

3. An omnidirectional antenna according to claim 2, wherein said plurality of pins are arranged in a star-shaped configuration.

4. An omnidirectional antenna according to claim 1, wherein said slot in said hollow cylindrical shaped radiating member is a transversely disposed annular slot (14) which separates the radiating member into two axially spaced members (17, 17*a*) to produce vertically polarized radiation, and a synthetic sleeve (18) which spans such slot (14) joining said axial spaced members (17, 17*a*) together.

5. An omnidirectional antenna according to claim 1, wherein a plurality of slots (43) formed in said hollow cylindrical shaped radiating member (42) which extend in a direction which is not parallel to said common axis.

* * * * *